US007316584B2

(12) United States Patent
Mackillop et al.

(10) Patent No.: US 7,316,584 B2
(45) Date of Patent: Jan. 8, 2008

(54) MATCHED IMPEDANCE SHIELDED PAIR INTERCONNECTION SYSTEM FOR HIGH RELIABILITY APPLICATIONS

(75) Inventors: William John Mackillop, Naperville, IL (US); James Friedhof, Hemet, CA (US)

(73) Assignee: Deutsch Engineered Connecting Devices, Inc., Hemet, CA (US)

( * ) Notice: Subject to any disclaimer, the term of this patent is extended or adjusted under 35 U.S.C. 154(b) by 0 days.

(21) Appl. No.: 11/531,680

(22) Filed: Sep. 13, 2006

(65) Prior Publication Data

US 2007/0259568 A1 Nov. 8, 2007

Related U.S. Application Data

(60) Provisional application No. 60/717,003, filed on Sep. 13, 2005.

(51) Int. Cl.
*H01R 13/648* (2006.01)

(52) U.S. Cl. ..... 439/608

(58) Field of Classification Search ..... 439/608, 439/934, 941

See application file for complete search history.

(56) References Cited

U.S. PATENT DOCUMENTS 6,077,122 A * 6/2000 Elkhatib et al. ..... 439/608

7,195,518 B2 * 3/2007 Bert et al. ..... 439/608

* cited by examiner

*Primary Examiner*—Tho D. Ta
(74) *Attorney, Agent, or Firm*—O'Melveny & Myers LLP

(57) ABSTRACT

A connector provides for attachment to a cable having a plurality of wires arranged in matched pairs. The connector comprises a housing and a connector insert located within the housing and having a plurality of contact cavities extending in an axial direction entirely therethrough. The connector insert further includes a substantially centrally located elongated opening extending in the axial direction from a proximal end thereof at least partially through the connector insert. The plurality of contact cavities are arranged substantially symmetrically with respect to the elongated opening. A conductive post is inserted into the elongated opening of the connector insert. The conductive post has elongated edges that provide shielding between respective pairs of the plurality of contact cavities. A follower is coupled to the conductive post. The follower has a plurality of passageways adapted to communicate respective ones of the matched pairs of wires to respective ones of the pairs of contact cavities. The follower thereby provides shielding between the respective pairs of wires. The connector further comprises a plurality of electrical contacts inserted into the respective ones of the plurality of contact cavities. The plurality of electrical contacts are adapted to be coupled to respective ones of the plurality of wires.

24 Claims, 13 Drawing Sheets

MATCHED IMPEDANCE SHIELDED PAIR INTERCONNECTION SYSTEM FOR HIGH RELIABILITY APPLICATIONS

RELATED APPLICATION DATA

This patent application claims priority pursuant to 35 U.S.C. § 119(e) to U.S. Provisional Pat. App. Ser. No. 60/717,003, filed Sep. 13, 2005.

BACKGROUND OF THE INVENTION

1. Field of the Invention

The present invention is directed towards connection systems for communicating electrical signals, and more particularly, to a high-reliability, matched impedance, shielded-pair interconnection system adapted for high speed data transmission up to and exceeding one gigabit per second for protocols such as Ethernet, 1394, USB, 1553, Fibre Channel, VME, Can-Buss, J1708, and the like.

2. Description of Related Art

With the increasing demand and complexity of modern electronic systems in high reliability applications such as military and aerospace, there is a continuing need to incorporate more electronic equipment into a confined space, while at the same time ensuring reliability in harsh environments. In such applications, connection systems provide a critical communication link between physically separated electronic devices. These connection systems have to satisfy many competing requirements. They should be capable of withstanding a rugged environment that includes vibration, wide temperature swings, moisture, and exposure to hazardous materials and chemical contaminants. They should also be compact to permit many interconnections to be made within a small area. And, they should have the highest quality electrical characteristics, with matched impedance, very low signal loss, and minimal crosstalk.

High reliability connection systems are often used to facilitate 100Base T and 1000Base T Ethernet applications such as those found in commercial avionics systems. Additional applications, for example, include aircraft data networks, in-flight entertainment systems (IFE) and other mil-aero networking applications where Gigabit Ethernet IEEE 802.3, Fibre Channel XT11.2, 1394, USB, 1553, Fibre Channel, VME, Can-Buss, J1708 or other multi-gigabit connectivity architecture is required. In such communication networks in which it is desirable to transfer data at high speeds over distances up to one-hundred meters, it is known to use balanced matched impedance copper cabling. The copper cables are connected to the various interfaces in a communications network using plug-in modular connectors. A conventional cable used to transfer data includes an insulating cable sheath that contains pairs of copper wires. The wires are twisted together in order to reduce crosstalk, which is a form of signal degradation that results when the signal on one wire is inductively coupled onto another adjacent wire. The Ethernet protocol uses four pairs per channel, and each pair needs to be shielded from the other pairs to preclude cross-talk between the pairs. Furthermore, when the channel is used in a full duplex manner, i.e., to support simultaneous bidirectional communications, it is also necessary to prevent disturbance by near end crosstalk and far end crosstalk from the other pairs. Thus, in a given Ethernet channel, there are six disturbing sources per pair. Consequently, both the position of the wires and the components of the modular connector all play a crucial role in preventing signal degradation.

Two commercially known modular connectors for Ethernet applications are the RJ-45 and the Quadrax contact. The RJ-45 is an eight-wire connector used commonly to connect computers onto local-area networks (LAN), especially in building applications. The connector or jack includes a generally plastic body having eight metal contacts that connect to four pairs of wires that terminate inside the jack. To attach the RJ-45 connector to a cable, about two inches of the cable sheath is stripped off exposing the four pairs of twisted wires. Each pair is untwisted and the wires are flattened out and trimmed down to approximately one-half an inch in length. These wires are inserted into the jack and connected to the metal contacts. A device such as a crimping tool is used to press down the contacts onto the wires, thereby terminating the wires in the RJ-45 connector.

Despite the prevalence and low cost of the RJ-45 connector, it also has many limitations. One drawback is that the wires have to be untwisted in order to be inserted into the jack. By untwisting the wires, even if over a small length of cable, the wires become susceptible to signal degradation due to crosstalk. Another drawback of the RJ-45 connection is that the connector is not environmentally sealed. The wires that terminate at the end of the jack are exposed to the environment and can become damaged by fluctuating temperature conditions and contaminants resulting in a poor electrical connection. Yet another drawback is that the contacts and other components of the connector are not repairable. If there is any damage to a contact, the entire connector must be removed and replaced. For these and other reasons, the RJ-45 does not meet military and aerospace specifications (Mil-DTL-38999, which has a Mil-STD-1560 insert performance requirement). Moreover, the contacts are not designed to meet vibration and shock requirements set out by these specifications. Furthermore, some wire designs require maintaining a matched impedance parallel geometry.

In lieu of the RJ-45, the Quadrax contact is used for many military or other high-reliability applications. Quadrax contacts are a multi-signal contact system employing two pairs for use with quad-axial cables. The contacts feature a one-piece dielectric design that helps simplify the termination process. The Quadrax contact has a cylindrical metal shell that is swaged to the braid of wires over a crimp support sleeve. The shell encloses four inner contacts that are intended to connect to two pairs of wires. Thus, two Quadrax contacts are required in order to connect four pairs of wires or one gigabit Ethernet cable. The two Quadrax contacts are contained in a size 17 shell, having an outside diameter of 1.415 inches, which is very bulky. The Quadrax contacts provide a significant improvement over the RJ-45 in terms of ruggedness and cross-talk reduction, but are not without other disadvantages. Even though the four pins are shielded overall, each pair is not shielded from the other. Additionally, the pins are prone to bending. Like the RJ-45, the inner contacts of the Quadrax contact are not repairable. Replacing the contacts requires cutting through the outer contact, which makes the assembly on the inner contacts non-repairable. Thus, the entire Quadrax contact needs to be replaced if there is any damage to the inner contacts.

For each of the foregoing reasons, a need exists for an improved matched impedance, shielded-pair interconnection system for high speed data transmission up to and exceeding one gigabit per second for harsh operating environments

SUMMARY OF THE INVENTION

The present invention satisfies the need for an improved interconnection system by providing a connector that carries plural matching pairs of conductors in a compact package in which each pair is isolated from each other to reduce cross-talk.

In an embodiment of the invention, a connector provides for attachment to a cable having a plurality of wires arranged in matched pairs. The connector comprises a housing and a connector insert located within the housing and having a plurality of contact cavities extending in an axial direction entirely therethrough. The connector insert further includes a substantially centrally located elongated opening extending in the axial direction from a proximal end thereof at least partially through the connector insert. The plurality of contact cavities are arranged substantially symmetrically with respect to the elongated opening. A conductive post is inserted into the elongated opening of the connector insert. The conductive post has elongated edges that provide shielding between respective pairs of the plurality of contact cavities. A follower is coupled to the conductive post. The follower has a plurality of passageways adapted to communicate respective ones of the matched pairs of wires to respective ones of the pairs of contact cavities. The follower thereby provides physical separation between the respective pairs of wires. The connector further comprises a plurality of electrical contacts inserted into the respective ones of the plurality of contact cavities. The plurality of electrical contacts are adapted to be coupled to respective ones of the plurality of wires.

The connector may be adapted to provide a socket (female) connection or a pin (male) connection. For a pin connection, the connector insert may further include a plurality of pins coupled to respective ones of the plurality of contact cavities at a distal end of the connector insert. The plurality of contact cavities may be arranged in a generally circular pattern or in a generally rectangular pattern. In a preferred embodiment, the plurality of contact cavities further comprises four pairs of contact cavities. The housing further comprises a boot portion adapted to enclose the follower, the boot portion having an opening permitting passage of the cable therethrough while maintaining an environmental seal around the cable. A separator may be coupled to the follower, the separator providing plural channels for guiding respective ones of the matched pairs of wires. The follower may be adapted to be symmetrically coupled to a braided shield material of the cable.

In another embodiment of the invention, a connector provides for attachment to plural cables with each having a plurality of wires arranged in matched pairs. The connector comprises a housing and a plurality of modules arranged within the housing. Each module includes a connector insert disposed within the housing and having a plurality of contact cavities extending in an axial direction entirely therethrough. The connector insert further has a substantially centrally located elongated opening extending in the axial direction from a proximal end thereof at least partially through the connector insert. The plurality of contact cavities are arranged substantially symmetrically with respect to the elongated opening. The module further comprises a conductive post inserted into the elongated opening of the connector insert. The conductive post has elongated edges that provide shielding between respective pairs of the plurality of contact cavities. The module further comprises a follower coupled to the conductive post, the follower having a plurality of passageways adapted to communicate respective ones of the matched pairs of wires to respective ones of the pairs of contact cavities. The follower provides shielding between the respective pairs of wires.

For each module, the plurality of contact cavities may be arranged in a generally circular pattern or in a generally rectangular pattern. In a preferred embodiment, the plurality of contact cavities of each module further comprises four pairs of contact cavities. Each module may be adapted to provide a socket (female) connection or a pin (male) connection. For a pin connection, the connector insert may further include a plurality of pins coupled to respective ones of the plurality of contact cavities at a distal end of the connector insert.

A more complete understanding of the matched impedance, shielded pair interconnection system will be afforded to those skilled in the art of data signal communications, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The invention satisfies the need for a matched impedance shielded pair interconnection system for high speed data transmission. In the detailed description that follows, like element numerals are used to describe like elements shown in one or more of the figures.

Figure 1A:
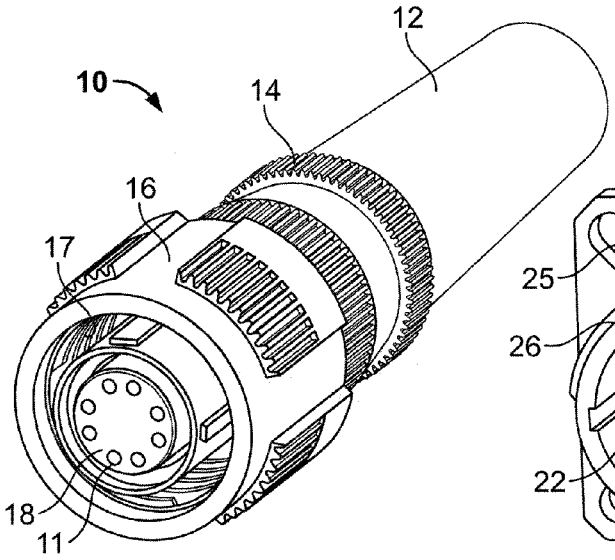
FIG. 1A is a perspective view of an exemplary connector plug.
Figure 1B:
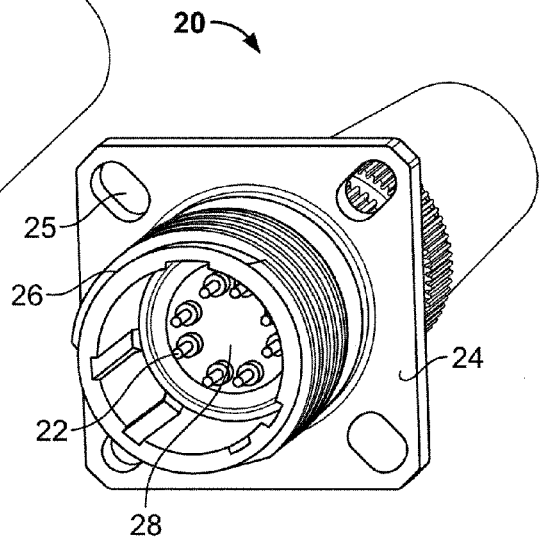
FIG. 1B is an perspective view of an exemplary connector receptacle.

In a first embodiment of the present invention, a connection system includes a plug 10 (shown in FIG. 1A) and a receptacle 20 (shown in FIG. 1B). The plug 10 and receptacle 20 are arranged to be coupled together to form an electrical connection between plural pairs of conductors. The plug 10 has a generally cylindrical outer shell comprising boot 12 and coupling nut 14, with one or more knurled bands circumscribing the outer perimeter of the coupling nut 14 to facilitate gripping. The outer shell has an outside diameter that is commonly referred to as a geometric shape such as a round Size 11 (i.e., 0.985 inches). The plug 10 further includes a rotatable collar 16 at a distal end thereof. The collar 16 has internal threads 17 adapted to engage a corresponding threaded sleeve 26 of the receptacle 20 to environmentally protect the interconnected conductors (described below). The collar 16 may further include knurled regions on the exterior surface that facilitate gripping of the collar as it is threaded onto the sleeve 26. The receptacle 20 further includes a flange 24 having a plurality of mounting holes 25 that enable the receptacle 20 to be affixed to a flat surface, such as an item of electrical equipment, a utility rack, junction box, bulkhead, wall or other surface.

The plug 10 has a cylindrical insert 18 that is concentrically located within the collar 16 and carried within the body structure of the plug. The insert 18 includes a plurality of sockets 11 housed inside contact cavities that extend axially within the plug body. The sockets 11 are arranged in a generally circular pattern and are visible at the distal end of the insert 18 (as shown in FIG. 1A). Similarly, the receptacle 20 includes a corresponding insert 28 having a plurality of protruding pins 22 at its distal end. The pins 22 are arranged in the same pattern as the sockets 11, such that the pins engage the sockets when the plug 10 is joined with the receptacle 20. The inserts 18, 28 are constructed of dielectric materials in order to provide electrical insulation between the pins 22 when engaged in the sockets 11. Thereafter, the collar 16 can threadingly engage the sleeve 26 to provide an environmental seal around the electrical connection. While the plug 10 was illustrated as having sockets 11 and the receptacle 20 was illustrated as having pins 22, it should be appreciated that the arrangement can be reversed depending upon the needs of a particular application. Indeed, the modular assembly of the plug 10 and receptacle 20 is intended facilitate configuration in any desired manner.

Figure 2:
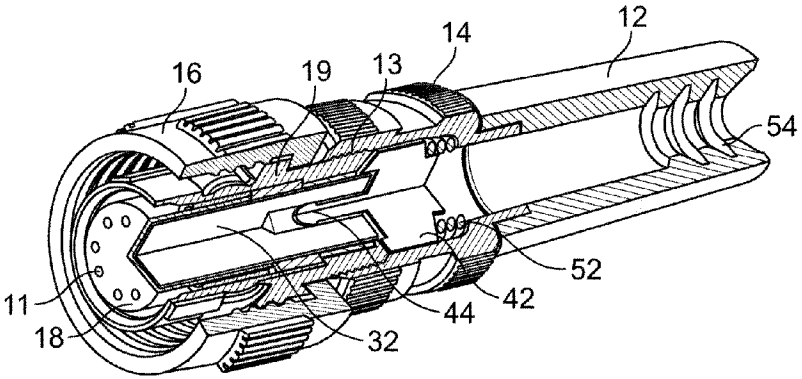
FIG. 2 is a partial cross-sectional view of the exemplary connector plug of FIG. 1A.

FIG. 2 shows a partial cross-sectional view of the exemplary connector plug 10. The connector plug 10 includes an internal body 19 that carries the insert 18. The coupling nut 14 is coupled to the internal body 19 using threads 13, and the boot 12 is permanently bonded to the coupling nut using adhesive. The proximal end of the boot 12, includes successive internal sealing rings or grommets 54 adapted to form an environmental seal around a cable (not shown) inserted into the connector plug 10. The connector insert 18 includes an internal passage that carries a conductive grounding post 32 (described below with respect to FIGS. 3A and 3B). The conductive grounding post 32 is further coupled to a follower 42 (described below with respect to FIG. 4). A plurality of washers 52 are disposed between the follower 42 and the proximal end of the coupling nut 14. It should be appreciated that the entire connector plug 10 can be disassembled by unthreading the coupling nut 14 from the internal body 19. The area inside the boot 12 proximal to the follower 42 is referred to as the wire management region, since it is within this region that the cable jacket is removed and the twisted-pairs of wires are prepared for mating with the connector.

Figure 3A:
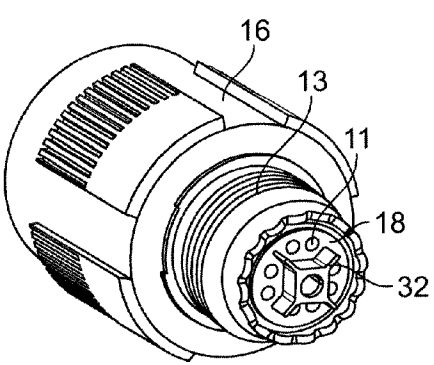
FIGS. 3A and 3B are enlarged partial views of the connector, plug of FIG. 1A with its outer shell removed, showing a conductive grounding post contained within the connector insert.
Figure 3B:
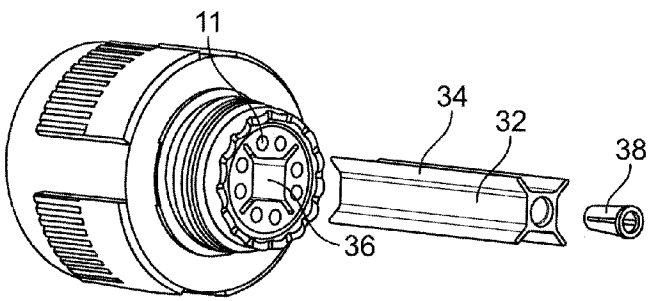

Referring now to FIGS. 3A and 3B, the distal end of the plug 10 is illustrated with the coupling nut 14 removed, exposing the proximal end of the connector insert 18 extending from the plug internal body 19. The insert 18 has an elongated opening 36 adapted to receive therein the conductive grounding post 32. The conductive grounding post 32 is formed of an extruded metal material having a generally cross-shape when viewed in cross-section. Peripheral edges 34 of the grounding post 32 extend outward from a generally rectangular central core to form elongated arcuate grooves or indentations that extend along the length and on each side of the grounding post 32. When inserted into the elongated opening 36, the grounding post 32 serves to separate each pair of sockets 11 from each other pair. Accordingly, the grounding post 32 provides electrical isolation between the socket pairs within the insert 18 to thereby control cross-talk between the adjacent pairs that may occur within the internal body 19 of the connector plug 10. The conductive grounding post 32 further has a central opening that extends at least partially therethrough, into which is inserted a socket 38.

Figure 4:
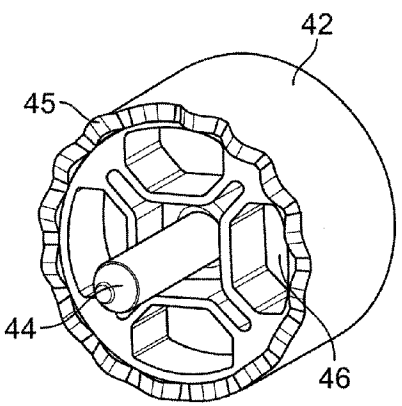
FIG. 4 is an enlarged partial view of a follower of the connector plug of FIG. 3.

The follower 42 is shown in greater detail in FIG. 4. The follower 42 has a cylindrical shape with a plurality of axial passageways that are symmetrically arranged along the outer perimeter of the follower. An axial post extends 44 from the center of the follower 42 and has a generally pointed tip. The follower 42 may be formed of electrically conductive materials, such as metal, a plastic material that is plated with conductive materials such as nickel or cadmium. Conductive materials would tend to provide additional shielding between the wire pairs. Alternatively, the follower 42 may be formed of non-conductive materials that would not provide shielding, but would physically separate the wire pairs in order to mitigate crosstalk. The follower 42 is arranged to be carried within the coupling nut 14 with the tip of the axial post 44 inserting into the opening of the conductive grounding post 32, so that the post engages and connects to the socket 38 (see FIG. 2). This interconnection between the follower 42 and the conductive grounding post 32 extends the electrical isolation between the twisted pairs of cables. More particularly, the twisted pairs of cables are inserted respectively through corresponding ones of the axial passageways before passing into the sockets 11 of the insert 18. Hence, the twisted pairs become untwisted in the region of the follower 42, and the follower provides electrical isolation between the pairs to minimize cross-talk.

Figure 5:
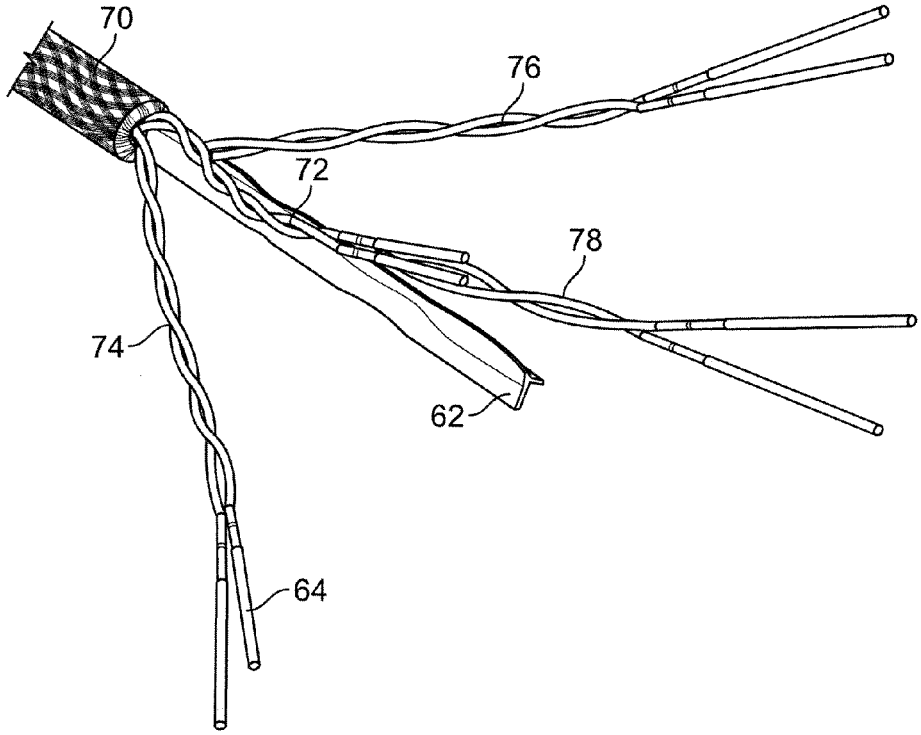
FIG. 5 illustrates a braid of four pairs of twisted wires attached to electrical contacts and having a non-conductive spline.
Figure 6:
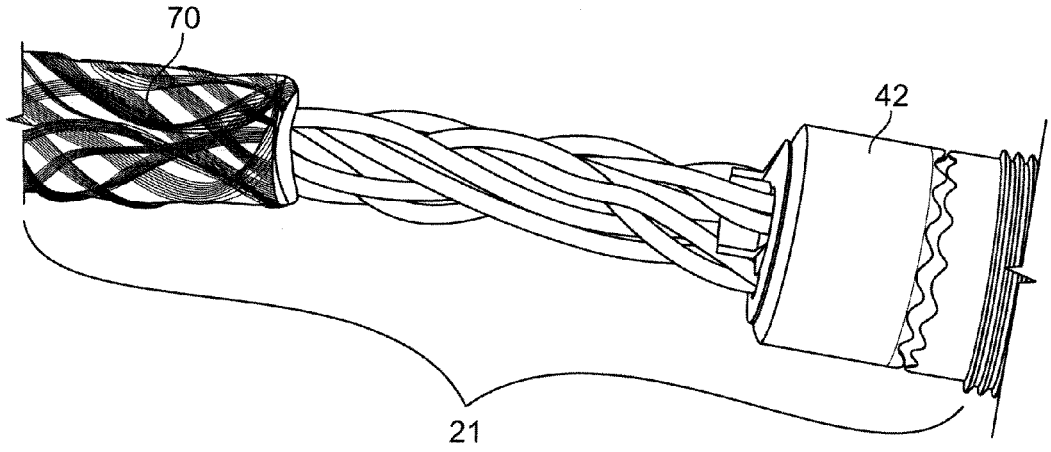
FIG. 6 illustrates the termination of the braid of wires to the exemplary connector through the follower.

As shown in FIG. 5, an exemplary electrical cable 70 has an outer jacket removed to expose the braided shield material with four twisted-pairs of wires 72, 74, 76, 78 contained therein. To attach the cable 70 to the connector plug or receptacle, the twisted-pairs are separated from each other, and contacts 64 are attached to the end of each individual wire. The twisted pairs are passed through the axial passageways of the follower 42 (see FIG. 6). These contacts are then inserted into respective ones of the contact cavities of the connecter insert 18. Lastly, the braided shield material of the cable 70 may be bonded to the body of the connector, such as by compressing the shield material between the proximal end of the follower 42 and one of the washers 52. For example, by wrapping the shield material back over one of the washers 52, the overall geometry of the shield material is maintained. This also serves to minimize insertion loss and maximize return loss through the cable management region, which further serves to optimize the propagating signal as it transitions from the cable to the connector.

Figure 7:
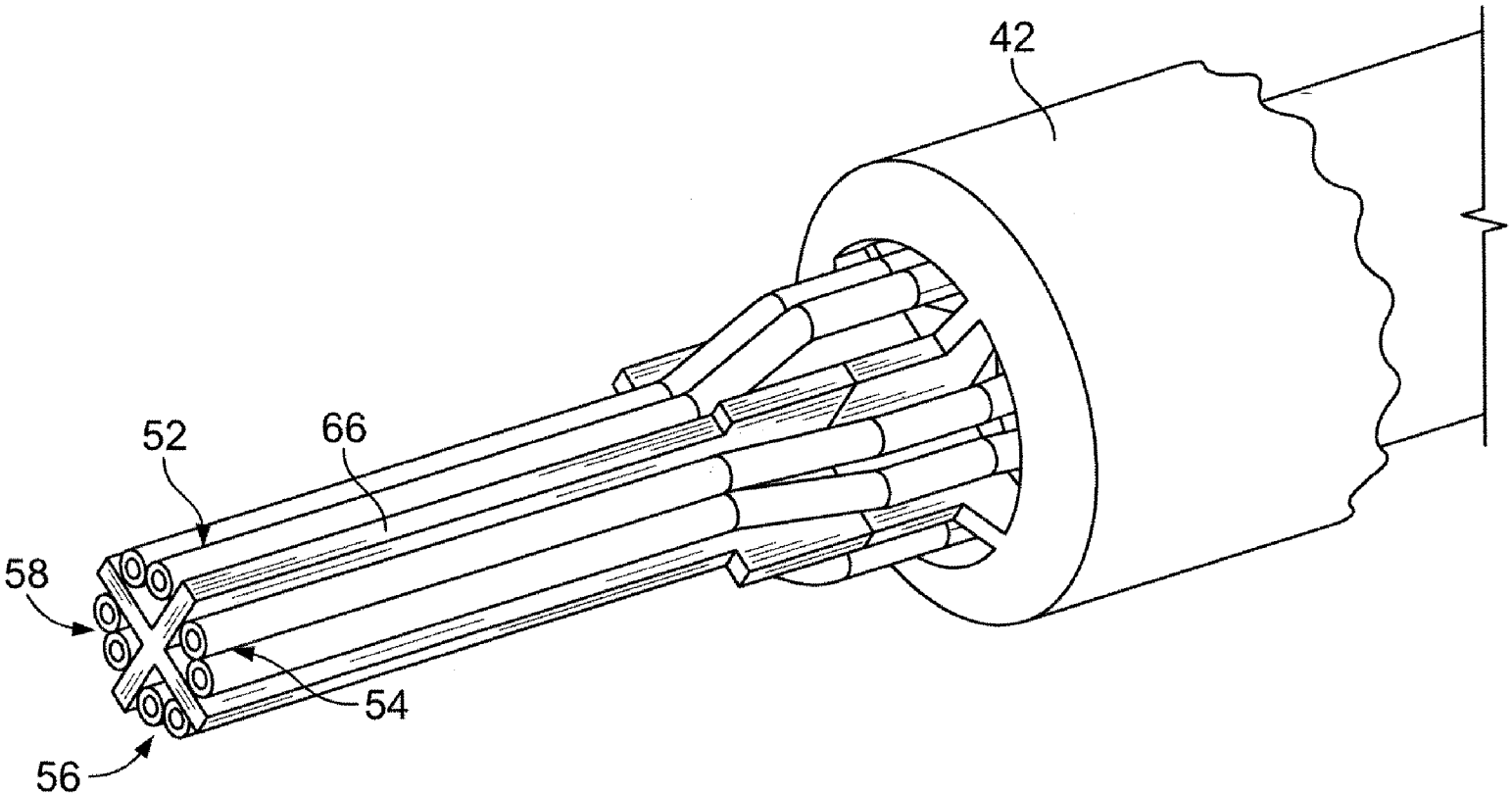
FIG. 7 illustrates a non-conductive separator placed between the wires.

In an embodiment of the invention, the cable 70 may include a non-conductive spline 62 that provides physical separation between the twisted-pairs of wires. The spline 62 may be made of Teflon™ or like materials. If it becomes necessary to replace one of the contacts 64, such as if the contact becomes bent or if an intermittent electrical connection is formed between the contact and associated wire, it is a relatively simple process to disassemble the connector and replace the contact. In an alternative embodiment of the invention, crosstalk within the connector may be further reduced by the use of a wire management separator 66, as illustrated in FIG. 7. The separator 66 extends from the follower 42 and can be used to maintain physical separation of each individual pair of wires from the other pairs in the wire management region and therefore allow the shielded pairs to remain spaced away from each other, thus reducing the crosstalk between pairs. The separator 66 may be constructed of non-conductive materials, such as plastic.

Thus, the follower 42 prevents interference by electrically isolating the pairs of wires throughout the wire management region and also by isolating each shielded pair from the others. The individual wires are further electrically isolated from one another by the conductive grounding post 32 as each wire is crimped or soldered to a contact and placed into the contact cavity in the insert 18. The conductive grounding post 32 isolates each pair by controlling the electrical fields to prevent crosstalk between pairs. Thus, any interference from any given wire in the connection system is minimized, as the four shielded pairs are placed in a unique and optimum arrangement for minimal reflection and maximum transmission. Moreover, the symmetrical arrangement of the conductors within the sockets 11 of the insert 18, with each conductor being disposed equidistant from adjacent conductors and other field effects, provides balanced electrical characteristics of the communicated signals.

Figure 8:
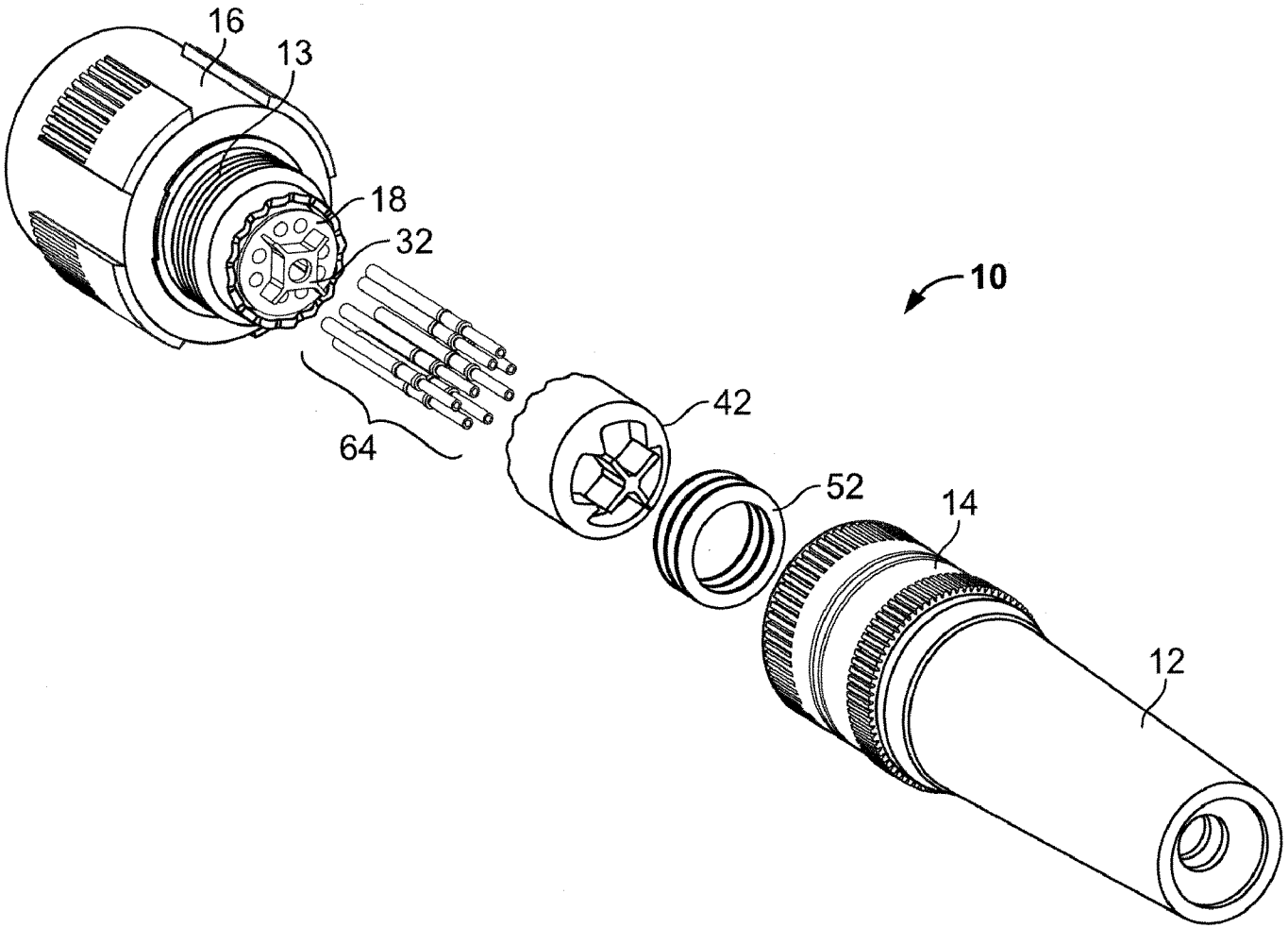
FIG. 8 is an exploded view of the connector plug of FIG. 1A.

Referring now to FIG. 8, an exploded view of an exemplary connector plug 10 is shown to illustrate its ease of disassembly. With the boot 12 and coupling nut 14 separated from the internal body 19, the washers 52 and follower 42 may be removed. Plural contacts 64 can be affixed to respective wires, such as by crimping or soldering, and inserted into respective ones of the contact cavities of the insert 18. The connector plug 10 is intended to comply with Mil-STD-1560 performance specifications, by using Military and Aerospace grade plastic inserts and elastomers for sealing.

Figure 9:
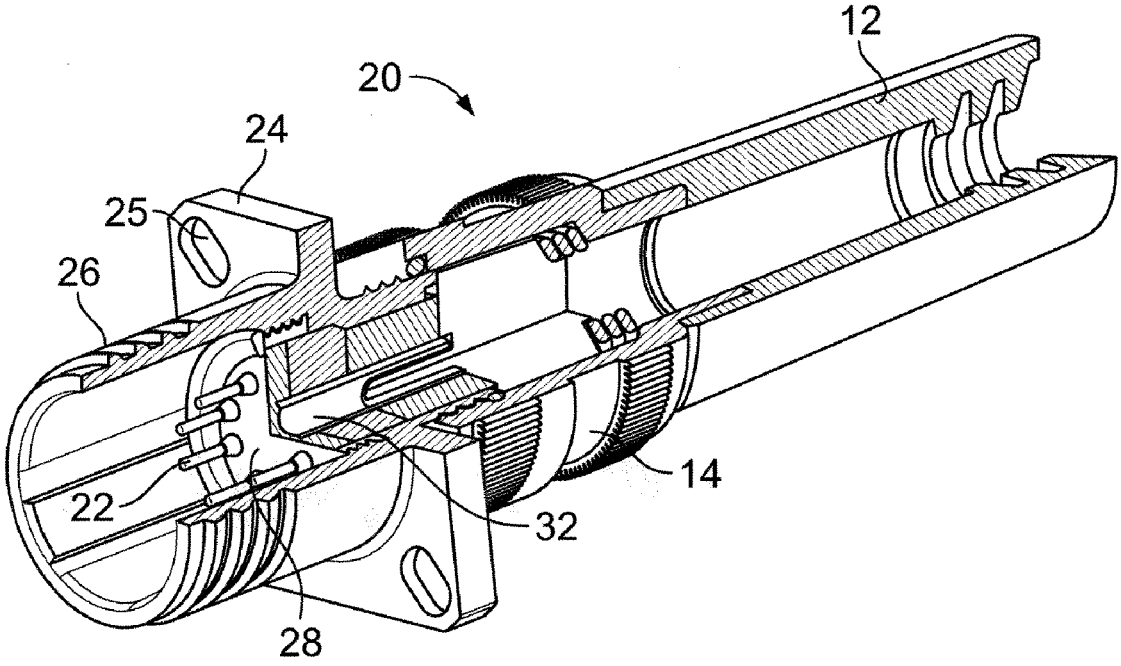
FIG. 9 illustrates a partial cross-sectional view of the connector receptacle of FIG. 1B.

Referring now to FIG. 9, a partial cross-sectional view of the exemplary connector receptacle 20 of FIG. 1B is shown. As discussed above, the receptacle 20 includes a flange 24 having a plurality of mounting holes 25. The receptacle 20 further includes an insert 28 having a plurality of protruding pins 22 at its distal end arranged in the same pattern as the sockets 11. Internally, the receptacle 20 has a generally similar construction as the connector plug 10. The insert 28 includes an internal passage that carries a conductive grounding post 32, that is further coupled to a follower 42. A plurality of washers 52 are disposed between the follower 42 and the proximal end of the coupling nut 14. The receptacle 20 can be disassembled by unthreading the coupling nut 14 from the internal body 19, in the same manner as the plug 10.

Figure 10A:
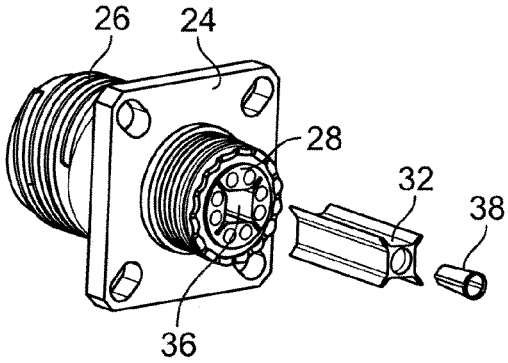
FIGS. 10A-10C are enlarged partial views of the connector receptacle of FIG. 1B with its outer shell removed, showing a conductive grounding post contained within the connector insert.
Figure 10B:
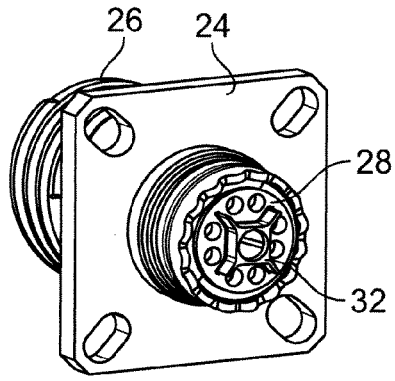
Figure 10C:
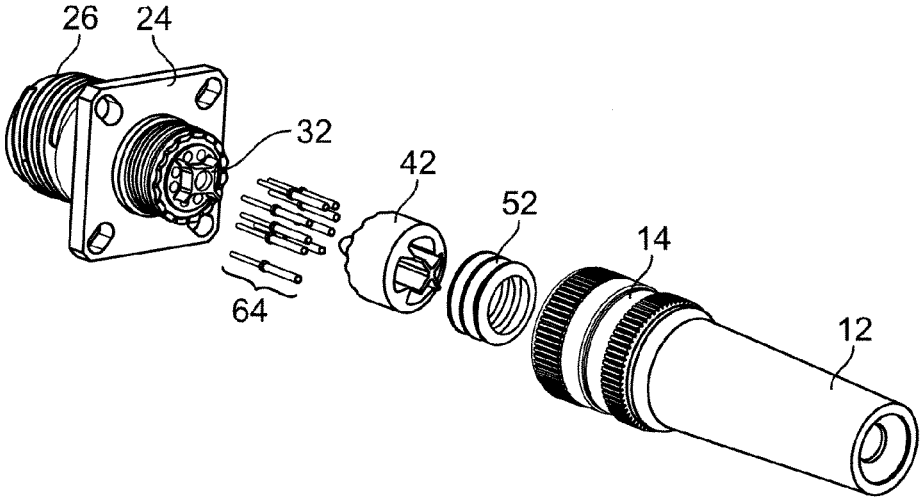

FIGS. 10A-10C show the distal end of the receptacle 20 with the coupling nut 14 removed, exposing the proximal end of the connector insert 28. As with the plug 10, the insert 28 has an elongated opening adapted to receive therein the conductive grounding post 32. When inserted into the elongated opening 36, the grounding post 32 serves to separate each pair of pins 22 from each other pair. Accordingly, the grounding post 32 provides electrical isolation between the pin pairs with the insert 28 to thereby control cross-talk between the adjacent pairs that may occur within the internal body of the connector receptacle 20. The conductive grounding post 32 further has a central opening that extends at least partially therethrough, into which is inserted a socket 38.

The follower 42 is arranged to be carried within the coupling nut 14 with the tip of the axial post 44 inserting into the opening of the conductive grounding post 32, so that the post engages and connects to the socket 38. This interconnection between the follower 42 and the conductive grounding post 32 extends the electrical isolation between the pairs (twisted and parallel) of cables. More particularly, the twisted pairs of cables are inserted respectively through corresponding ones of the axial passageways before passing into the pins 22 of the insert 28. Hence, the pairs become untwisted in the region of the follower 42, and the follower provides electrical isolation between the pairs to minimize cross-talk.

Figure 11A:
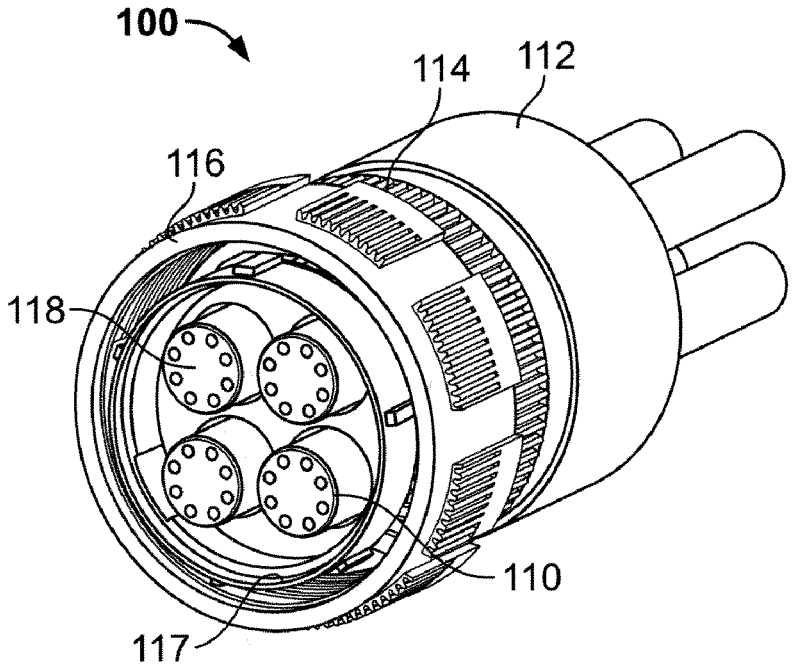
FIG. 11A illustrates an alternative connector plug having four modules.
Figure 11B:
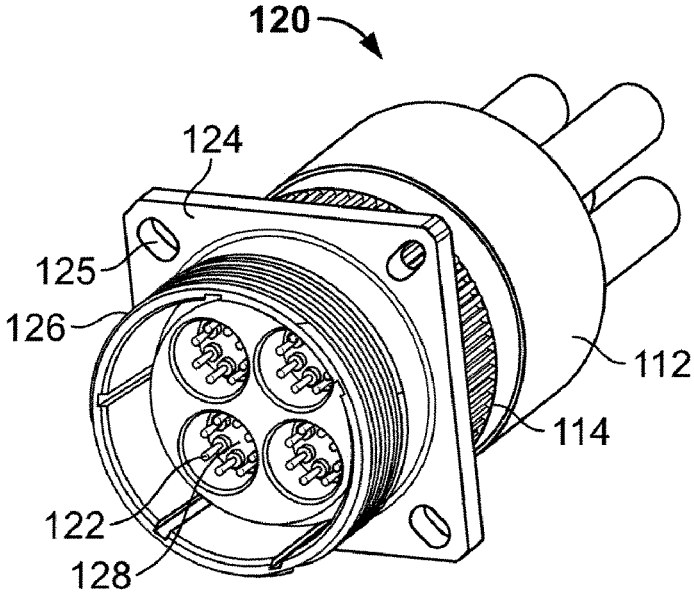
FIG. 11B illustrates an alternative connector receptacle having four modules.

An alternative embodiment of the invention is shown in FIGS. 11A and 11B. The alternative connection system includes a plug 100 (shown in FIG. 11A) and a receptacle 120 (shown in FIG. 11B). The plug 100 and receptacle 120 are arranged to be coupled together to form an electrical connection between plural pairs of conductors. Unlike the preceding embodiment, the plug 100 and receptacle 120 are each arranged to carry four eight-pin modules within a Size 25 connector body. Each of the individual modules has a construction generally similar to that of the preceding embodiments.

More particularly, the plug 100 has a generally cylindrical outer shell comprising boot 112 and coupling nut 114, with one or more knurled bands circumscribing the outer perimeter of the coupling nut 114 to facilitate gripping. The plug 100 further includes a rotatable collar 116 at a distal end thereof. The collar 116 has internal threads 117 adapted to engage a corresponding threaded sleeve 126 of the receptacle 120 to environmentally protect the interconnected conductors (described below). The collar 116 may further include knurled regions on the exterior surface that facilitate gripping of the collar as it is threaded onto the sleeve 126. The receptacle 120 further includes a flange 124 having a plurality of mounting holes 125 that enable the receptacle 120 to be affixed to a flat surface, such as an item of electrical equipment, a utility rack, junction box, bulkhead, wall or other surface.

Each of the four socket modules of the plug 100 has a cylindrical insert 118 that is symmetrically located within the collar 116 and carried within the body structure of the plug. The insert 118 includes a plurality of sockets 110 that extend axially within the plug body. The sockets 110 are arranged in a generally circular pattern and are visible at the distal end of the insert 118 in the same manner as the preceding plug embodiment shown in FIG. 1A. Similarly, each of the four pin modules of the receptacle 120 includes a corresponding insert 128 having a plurality of protruding pins 122 at its distal end. The pins 122 are arranged in the same pattern as the sockets 110, and the modules arranged in the same pattern, such that the pins engage the sockets of all four modules when the plug 100 is joined with the receptacle 120. The inserts 118, 128 are constructed of dielectric materials in order to provide electrical insulation between the pins 122 when engaged in the sockets 110. Thereafter, the collar 116 can threadingly engage the sleeve 126 to provide an environmental seal around the electrical connection. While the plug 100 was illustrated as having sockets 110 and the receptacle 120 was illustrated as having pins 122, it should be appreciated that the arrangement can be reversed depending upon the needs of a particular application.

Figure 12:
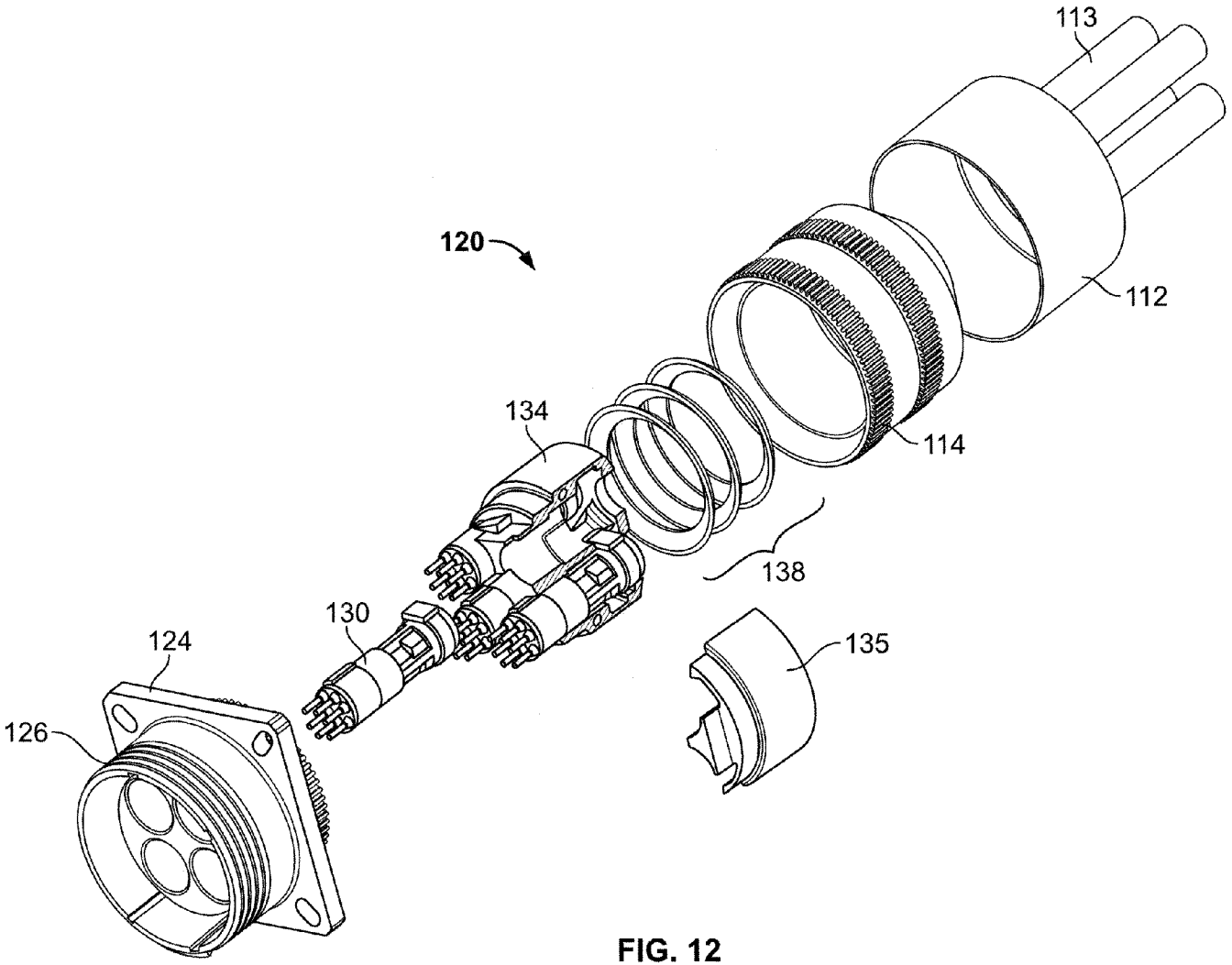
FIG. 12 is an exploded view of the connector receptacle of FIG. 11B.

FIG. 12 illustrates an exploded view of the connector receptacle 120 of FIG. 11B, with the coupling nut 114 and boot 112 removed to expose a plurality of pin modules 130. Each pin module 130 has a construction similar to the receptacle of FIG. 1B described above, and include an insert having an internal passage that carries a conductive grounding post that is further coupled to a follower. The conductive grounding post and follower each perform the same function and have the same construction as described above. The plurality of pin modules 130 are carried within a common module housing 134. A module retainer 135 attaches to the module housing 134 to enclose the modules within the housing. A plurality of washers 138 are disposed between the header 134 and the interior of the coupling nut 114. Lastly, the boot 112 engages the proximal end of the coupling nut 114 to enclose the connector receptacle 120. The boot 112 includes a plurality of tubes that carry respective cables into the connector body. The tubes may be made of heat-shrinkable material in order to provide an environmental seal within the connector.

Figure 13A:
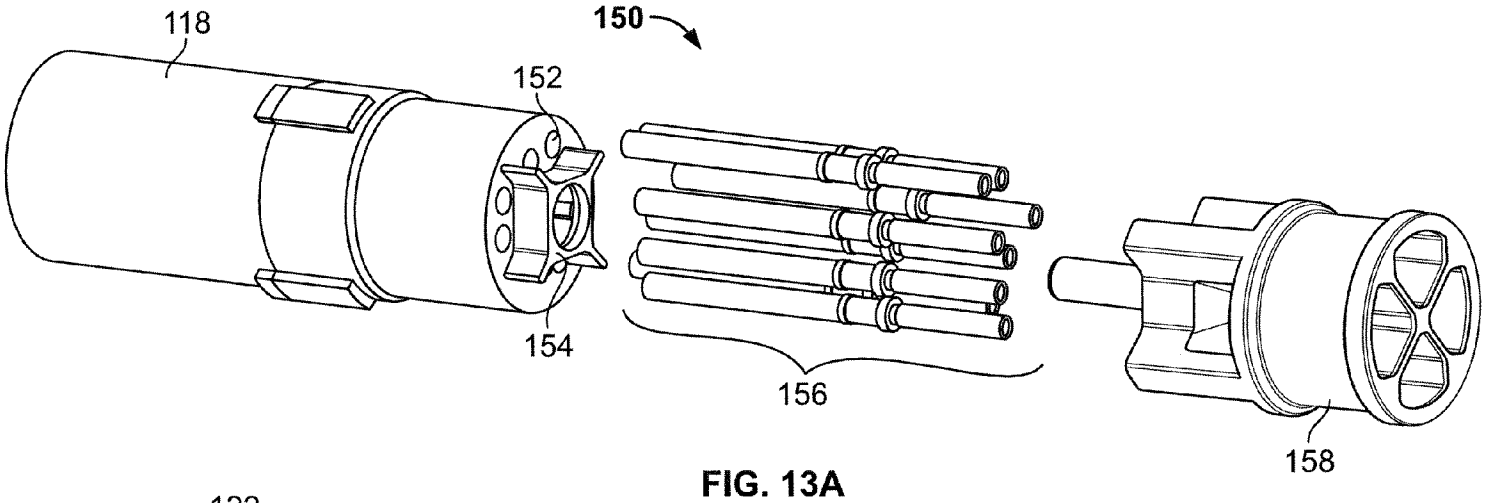
FIG. 13A illustrates an exploded view of an individual socket module of the connector plug of FIG. 11A.

An individual socket module 150 is shown in further detail in FIG. 13A. The socket module 150 includes the insert 118 having a plurality of contact cavities and an elongated opening to carry a conductive grounding post 152. The conductive grounding post 152 has a configuration identical to that described above such that respective pairs of contact cavities are electrically isolated from one another. A plurality of contacts 156 are inserted into respective ones of the contact cavities in insert 118, with each contact being coupled to a respective wire as described above. A follower 158 has a center post and plurality of axial passageways arranged symmetrically through the body of the follower. The center post of the follower 158 that is adapted to engage the conductive grounding post 152 in the same manner described above.

Figure 13B:
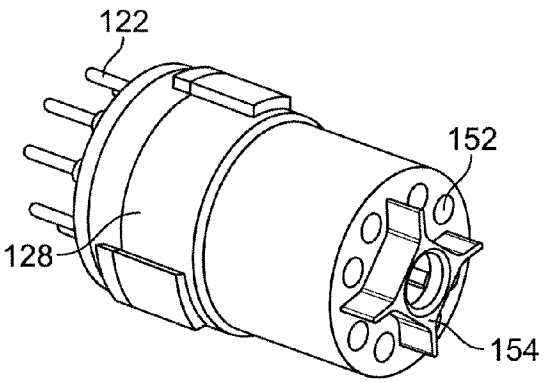
FIG. 13B illustrates an exploded view of an individual pin module of the connector receptacle of FIG. 11B.
Figure 13B:
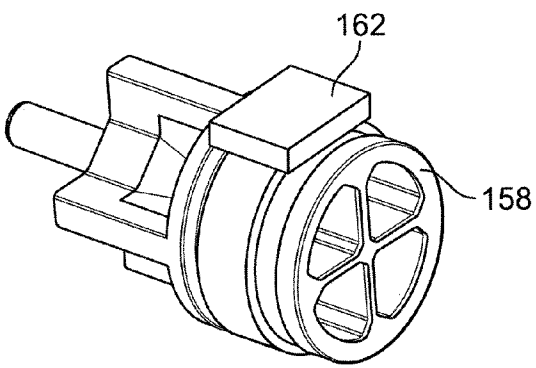

Likewise, an individual pin module 130 is shown in further detail in FIG. 13B. The pin module 130 includes the insert 128 having a plurality of pins 122 extending from a distal end thereof. The proximal end of the insert includes a plurality of contact cavities coupled to the pins 122, and an elongated opening to carry a conductive grounding post 152. The conductive grounding post 152 has a configuration identical to that described above such that respective pairs of contact cavities are electrically isolated from one another. A plurality of contacts (not shown) would be inserted into respective ones of the contact cavities in the same manner described above with respect to FIG. 13A. A follower 158 has a center post that is adapted to engage the conductive grounding post 152 in the same manner described above.

Figure 14:
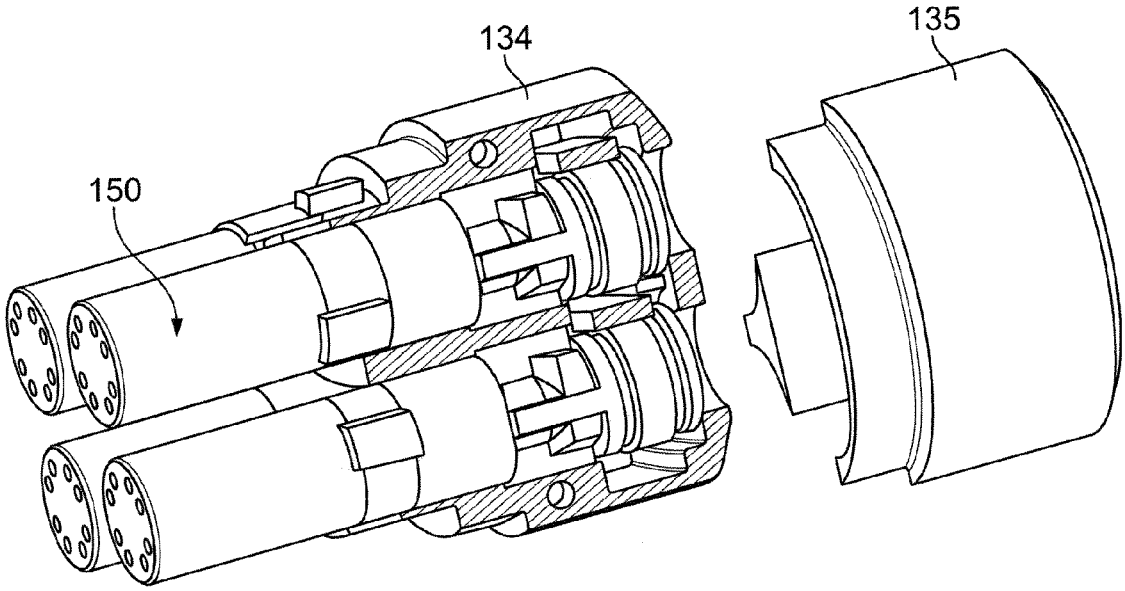
FIG. 14 is an exploded view of a module housing adapted to carry four socket modules.

After each module is populated with wired contacts, the follower 158 is mated with the grounding post 152. The wire will pass through the follower 158 in the same manner described above. The braided shield material of each of the four cables would be folded back over the outer surface of each follower 158 and held in place by a fastener 162, such as a conventional Bandit-type fastener. As shown in FIG. 14, four socket modules 150 are then placed within the module housing 134 and locked in place by the module retainer 135. The module housing 134 is keyed to control the orientation of modules. It should be appreciated that the same module housing 134 and module retainer 135 would be used with the pin modules 130.

Figure 15A:
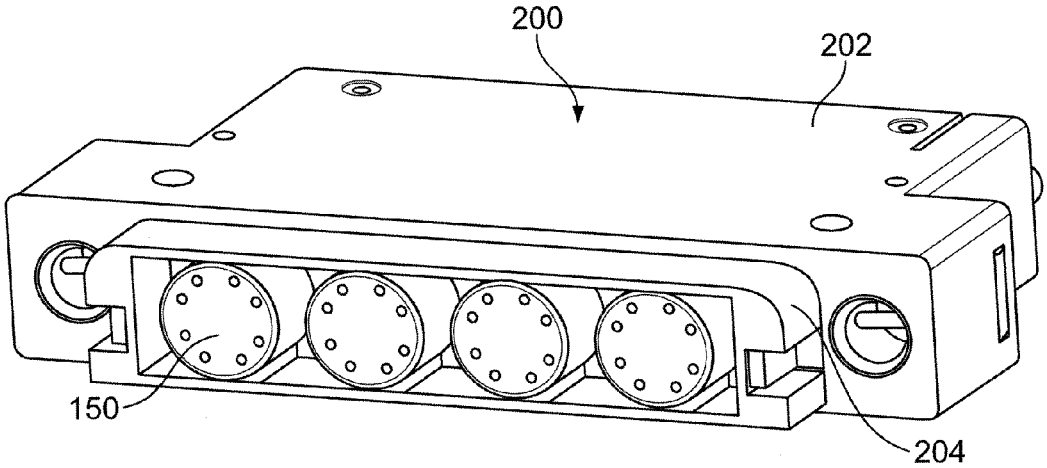
FIGS. 15A and 15B illustrate an alternative embodiment of the connection system having four modules contained in an exemplary rectangular connector body.
Figure 15B:
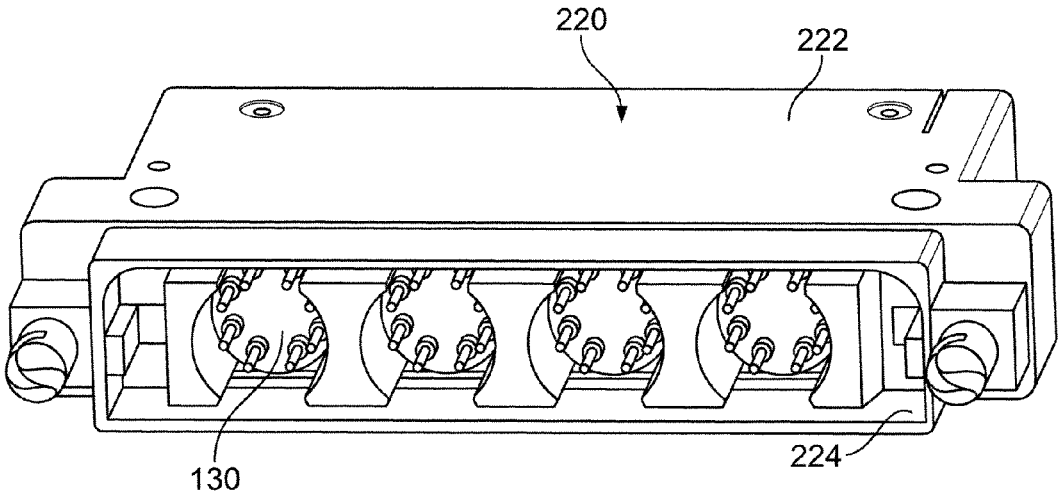

In another embodiment of the present invention, the above described pin and socket modules may be utilized within a rectangular connector, as shown in FIGS. 15A and 15B, respectively. In FIG. 15A, a first connector 200 includes a generally rectangular body 202 having a front face in which four socket modules 150 are disposed in a linear arrangement. The distal ends of the socket modules 150 protrude within a connector plug 204. Similarly, in FIG. 15B, a second connector 220 includes a generally rectangular plug body 222 having a front face in which four pin modules 130 are disposed in a linear arrangement. The distal ends of the pin modules 130 protrude within a connector socket 224 that has a shape corresponding to plug 204. It should be appreciated that the arrangement of pin and socket modules within the first and second connectors can be reversed.

Figure 16B:
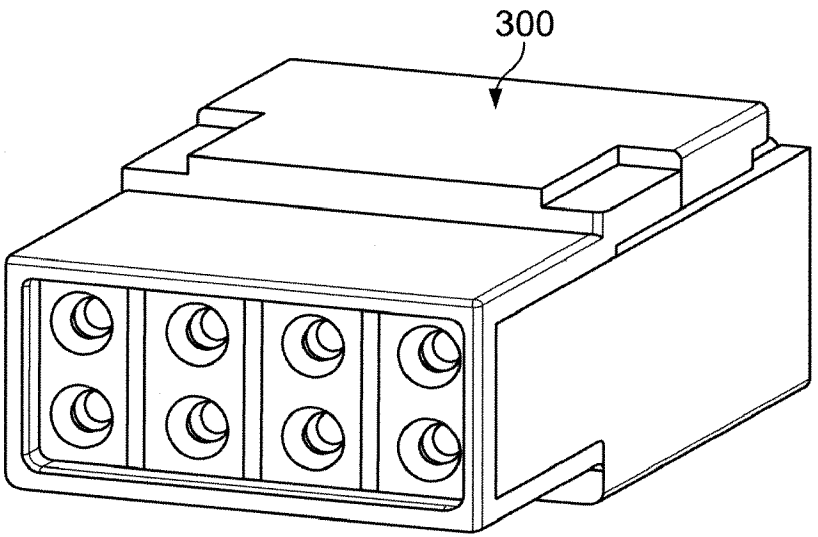
FIGS. 16A and 16B illustrate another alternative embodiment of the connection system in which the shielded pairs are arranged in a rectangular pattern.
Figure 16A:
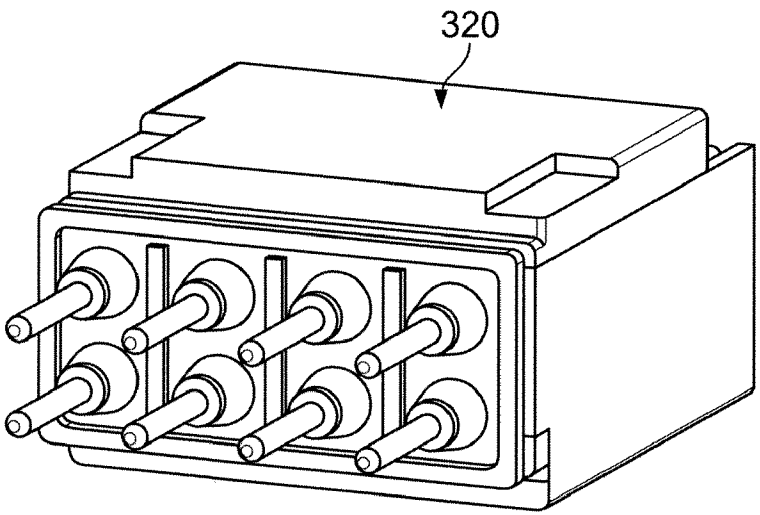

In yet another embodiment of the present invention, the arrangement of pins or sockets within a module can be rectangular rather than circular. FIGS. 16A and 16B illustrate rectangular pin and socket modules, 320, 300 respectively, that can be inserted in either a circular connector or a rectangular connector. Moreover, the modules can include one or more shielded pairs, depending on the use of the connector.

It is anticipated that the connection system of the present invention be adapted to use standard military specification contacts and insertion/removal tools. Accordingly, the present connection system would be sufficiently robust for vibration and shock, and meet the harsh environmental requirements of Mil-C-38999. The use of the conductive grounding post and the follower for the electrical isolation of shielded pairs may be used in other Military and Aerospace Specifications, such as Mil-C-81511, Mil-C-26482, Mil-C-83723, Mil-C-29600, EN, BS, ARINC, etc. These specifications generally rely on the Mil-STD 1560 for the insert performance criteria.

In addition to the advantage of meeting Military and Aerospace specifications, the present invention has significant advantages over the prior art. For example, four shielded pairs may be placed in a unique and optimized arrangement for minimal reflection and maximum transmission, allowing for little to no crosstalk. The contacts are crimpable and insert/removable for easy assembly and repairability. Also, the insert or module is environmental and fluid resistant. An exemplary Size 25 shielded pair signaling connector has the added advantage of terminating four shielded pair signaling cables in one connector. Each insert or module may have various shielded pairs placed in the same unique and optimized arrangement as the exemplary Size 11 connector module, providing the same advantages. Furthermore, each module is electrically isolated from the other, further reducing crosstalk between modules and is in optimized positions within the plated insert for minimal reflection.

Having thus described the various embodiments of a matched impedance, shielded pair, high-reliability interconnection system, it should be apparent to those skilled in the art that certain advantages have been achieved. It should also be appreciated that various modifications, adaptations, and alternative embodiments thereof may be made within the scope and spirit of the present invention. The invention is solely defined by the following claims.

What is claimed is:

1. A connector for attachment to a cable having a plurality of wires arranged in matched pairs, comprising:

a housing;

a connector insert disposed within the housing and having a plurality of contact cavities extending in an axial direction entirely therethrough, the connector insert further having a substantially centrally located elongated opening extending in the axial direction from a proximal end thereof at least partially through the connector insert, the plurality of contact cavities being arranged substantially symmetrically with respect to the elongated opening;

a conductive post inserted into the elongated opening of the connector insert, the conductive post having elongated edges that provide shielding between respective pairs of the plurality of contact cavities; and a follower coupled to the conductive post, the follower having a plurality of passageways adapted to communicate respective ones of the matched pairs of wires to respective ones of the pairs of contact cavities, the follower providing physical separation between the respective pairs of wires.

2. The connector of claim 1, further comprising a plurality of pins coupled to respective ones of the plurality of contact cavities at a distal end of the connector insert.

3. The connector of claim 1, further comprising a plurality of electrical contacts inserted into the respective ones of the plurality of contact cavities, the plurality of electrical contacts being adapted to be coupled to respective ones of the plurality of wires.

4. The connector of claim 1, wherein the elongated edges of the conductive post extend between the respective pairs of contact cavities.

5. The connector of claim 1, wherein the housing further comprises a boot portion adapted to enclose the follower, the boot portion having an opening permitting passage of the cable therethrough while maintaining an environmental seal around the cable.

6. The connector of claim 1, further comprising a non-conductive separator coupled to the follower, the separator providing plural channels for guiding respective ones of the matched pairs of wires.

7. The connector of claim 1, wherein the follower is adapted to be symmetrically coupled to a braided shield material of the cable.

8. The connector of claim 1, wherein the housing further comprises a rotatable collar circumscribing the distal end of the connector insert.

9. The connector of claim 1, wherein the housing further comprises a threaded sleeve circumscribing the distal end of the connecter insert.

10. The connector of claim 1, wherein the plurality of contact cavities are arranged in a generally circular pattern.

11. The connector of claim 1, wherein the plurality of contact cavities are arranged in a generally rectangular pattern.

12. The connector of claim 1, wherein the plurality of contact cavities further comprise four pairs of contact cavities.

13. A connector for attachment to plural cables with each having a plurality of wires arranged in matched pairs, comprising:

a housing;

a plurality of modules arranged within the housing, each module including:

a connector insert disposed within the housing and having a plurality of contact cavities extending in an axial direction entirely therethrough, the connector insert further having a substantially centrally located elongated opening extending in the axial direction from a proximal end thereof at least partially through the connector insert, the plurality of contact cavities being arranged substantially symmetrically with respect to the elongated opening;

a conductive post inserted into the elongated opening of the connector insert, the conductive post having elongated edges that provide shielding between respective pairs of the plurality of contact cavities; and a follower coupled to the conductive post, the follower having a plurality of passageways adapted to communicate respective ones of the matched pairs of wires to respective ones of the pairs of contact cavities, the follower providing physical separation between the respective pairs of wires.

14. The connector of claim 13, wherein each module further comprises a plurality of pins coupled to respective ones of the plurality of contact cavities at a distal end of the connector insert.

15. The connector of claim 13, wherein each module further comprises a plurality of electrical contacts inserted into the respective ones of the plurality of contact cavities, the plurality of electrical contacts being adapted to be coupled to respective ones of the plurality of wires.

16. The connector of claim 13, wherein the elongated edges of the conductive post extend between the respective pairs of contact cavities.

17. The connector of claim 13, wherein the housing further comprises a boot portion adapted to enclose the follower of each module, the boot portion having an opening permitting passage of the cable therethrough while maintaining an environmental seal around the cable.

18. The connector of claim 13, further comprising a non-conductive separator coupled to the follower of each module, the separator providing plural channels for guiding respective ones of the matched pairs of wires.

19. The connector of claim 13, wherein the follower of each module is adapted to be symmetrically coupled to a braided shield material of the cable.

20. The connector of claim 13, wherein the housing further comprises a rotatable collar circumscribing the distal end of the connector insert.

21. The connector of claim 13, wherein the housing further comprises a threaded sleeve circumscribing the distal end of the connecter insert.

22. The connector of claim 13, wherein the plurality of contact cavities of each module are arranged in a generally circular pattern.

23. The connector of claim 13, wherein the plurality of contact cavities of each module are arranged in a generally rectangular pattern.

24. The connector of claim 13, wherein the plurality of contact cavities of each module further comprise four pairs of contact cavities.

* * * * *